US012788102B2

(12) United States Patent
Shahid A et al.

(10) Patent No.: US 12,788,102 B2
(45) Date of Patent: Nov. 10, 2026

(54) CALF ADJUSTABLE BOOT

(71) Applicant: PIP Manufacturing, Inc., Latham, NY (US)

(72) Inventors: Naveed Shahid A, Charlotte, NC (US); Raviteja Tata, Charlotte, NC (US); Nancy Casillas Owens, Charlotte, NC (US)

(73) Assignee: PIP Manufacturing, Inc., Latham, NY (US)

( * ) Notice: Subject to any disclaimer, the term of this patent is extended or adjusted under 35 U.S.C. 154(b) by 0 days.

(21) Appl. No.: 19/054,165

(22) Filed: Feb. 14, 2025

(65) Prior Publication Data

US 2025/0288048 A1 Sep. 18, 2025

(30) Foreign Application Priority Data

Mar. 15, 2024 (IN) ..... 202411019121

(51) Int. Cl.
*A43B 3/02* (2006.01)
*A43B 3/26* (2006.01)

(52) U.S. Cl.
CPC . *A43B 3/02* (2013.01); *A43B 3/26* (2013.01)

(58) Field of Classification Search
CPC ..... A43B 3/02; A43B 3/04; A43B 3/26
See application file for complete search history.

(56) References Cited

U.S. PATENT DOCUMENTS 671,711 A * 4/1901 Soderberg ..... A43C 5/00 24/713.3
3,855,715 A * 12/1974 Johnson ..... A44B 19/34 24/387
4,745,693 A * 5/1988 Brown ..... A43C 11/12 36/15
6,604,477 B1 * 8/2003 Hozan ..... A43C 11/12 2/243.1
8,136,267 B2 * 3/2012 Barnett ..... A43B 3/242 36/51
2008/0092408 A1 * 4/2008 Yeung ..... A43B 3/102 36/101

FOREIGN PATENT DOCUMENTS

CN 111700338 A * 9/2020 ..... A43B 23/0245
KR 20120113536 A * 10/2012 ..... A43B 23/07
KR 20180012941 A * 2/2018 ..... A43B 3/02
KR 101978717 B1 * 5/2019 ..... C08K 5/0025

OTHER PUBLICATIONS

English Translation of KR20120113536 (Year: 2012).*
English Translation of KR20180012941 (Year: 2018).*
English Translation of CN111700338 (Year: 2020).*
English Translation of KR 101978717 (Year: 2019).*

* cited by examiner

*Primary Examiner* — Ted Kavanaugh
(74) *Attorney, Agent, or Firm* — Fredrikson & Byron, P.A.

(57) ABSTRACT

A calf adjusted boot is disclosed. The calf adjustable boot comprises an upper shaft and at least one lining coupled to an inner surface of the upper shaft. Further, the calf adjustable boot comprises at least one zipper assembly coupled to the upper shaft. Each zipper assembly comprises a slider. Each slider is configured to move from a top position to a bottom position, wherein moving the at least one slider from the top position to the bottom position increases a circumference of the upper shaft.

20 Claims, 7 Drawing Sheets

CALF ADJUSTABLE BOOT

CROSS-REFERENCE TO RELATED APPLICATIONS

This application claims priority pursuant to 35 U.S.C. 119(a) to Indian Application No. 202411019121, filed Mar. 15, 2024, which application is incorporated herein by reference in its entirety.

TECHNOLOGICAL FIELD

Example embodiments of this invention relate generally to adjustable boots and, more particularly, to calf adjustable firefighter boots.

BACKGROUND

Conventionally, the construction and functioning of boots are important aspects of firefighters' safety gear. The boots may increase protection to the firefighter while they are performing their duties. The firefighter boots need to have a standard boot height devised by the National fire protection association and therefore, have limited calf space. The limited calf space significantly affects lower body mobility, demonstrating a strong relationship between firefighters' operational freedom and the required boot height. Shorter firemen with heavier build have a difficult time since their heavier calves make it harder for them to move their lower bodies and maneuver through dynamic operating settings. Such restrictions not only compromise the agility of shorter and heavier firefighters but also subject them to heightened stress during crucial firefighting operations. Existing limitations in calf fit space and mobility issues highlight a pressing need for technical advancements in firefighter boot design.

The applicant has identified numerous areas of improvement in the existing technologies and processes, which are the subjects of embodiments described herein. Through applied effort, ingenuity, and innovation, many of these deficiencies, challenges, and problems have been solved by developing solutions that are included in embodiments of this invention, some examples of which are described in detail herein.

BRIEF SUMMARY

The following presents a simplified summary to provide a basic understanding of some aspects of this invention. This summary is not an extensive overview and is intended to neither identify key or critical elements nor delineate the scope of such elements. Its purpose is to present some concepts of the described features in a simplified form as a prelude to the more detailed description that is presented later.

In an example embodiment, a calf adjustable boot is disclosed. The calf adjustable boot comprises an upper shaft and at least one lining coupled to an inner surface of the upper shaft. Further, the calf adjustable boot comprises at least one zipper assembly coupled to the upper shaft. Each zipper assembly comprises a slider. Each slider is configured to move from a top position to a bottom position, wherein moving the at least one slider from the top position to the bottom position increases a circumference of the upper shaft.

In some embodiments, each slider is configured to lock at the top position and at the bottom position. In some embodiments, each slider is a locking slider that is configured to lock at a plurality of positions. In some embodiments, the plurality of positions comprising the top position, the bottom position, and at least one intermediate position.

In some embodiments, each of the plurality of positions are spaced apart from at least one adjacent position by a distance. The distance between each of the plurality of positions is configured to adjust the circumference of the upper shaft by an interval, each interval being equal. In some embodiments, each interval is 1 inch.

In some embodiments, each of the plurality of positions are spaced apart from at least one adjacent position by a distance, wherein the distance for each is equal.

In some embodiments, each lining is waterproof. In some embodiments, each lining is bonded onto the inner surface of the upper shaft. In some embodiments, each lining is waterproof and is configured to prevent water from seeping into an interior of the calf adjustable boot. In some embodiments, each lining is a bellow lining that is configured to expand as the circumference of the upper shaft increases.

In some embodiments, at least one flap is coupled to an outer surface of the upper shaft. The at least one flap is configured to protect the at least one zipper assembly and the at least one lining from fire exposure. In some embodiments, the at least one flap is a flame and heat-resistant material that is capable of withstanding temperature of 260 degrees Celsius. In some embodiments, the at least one flap comprises at least one of a plurality of hooks or a plurality of loops of a hook and loop fastener.

In some embodiments, each zipper assembly is positioned between a respective flap and a respective lining.

In some embodiments, at least two pull straps are stitched on an outer surface of the upper shaft and in proximity to the at least one zipper assembly. The at least two pull straps are configured to be pulled up to adjust the calf adjustable boot near the calf.

In some embodiments, the calf adjustable boot has a height of 14 inches.

In some embodiments, each zipper assembly comprises a top stop that is positioned proximate to a top of the calf adjustable boot. In some embodiments, each zipper assembly comprises a bottom stop that is positioned within 2 to 3 inches of a bottom of the calf adjustable boot.

The above summary is provided merely for purposes of summarizing some example embodiments to provide a basic understanding of some aspects of this invention. Accordingly, it will be appreciated that the above-described embodiments are merely examples and should not be construed to narrow the scope or spirit of this invention in any way. It will be appreciated that the scope of the present disclosure encompasses many potential embodiments in addition to those here summarized, some of which will be further described below.

BRIEF DESCRIPTION OF THE DRAWINGS

Figure 1:
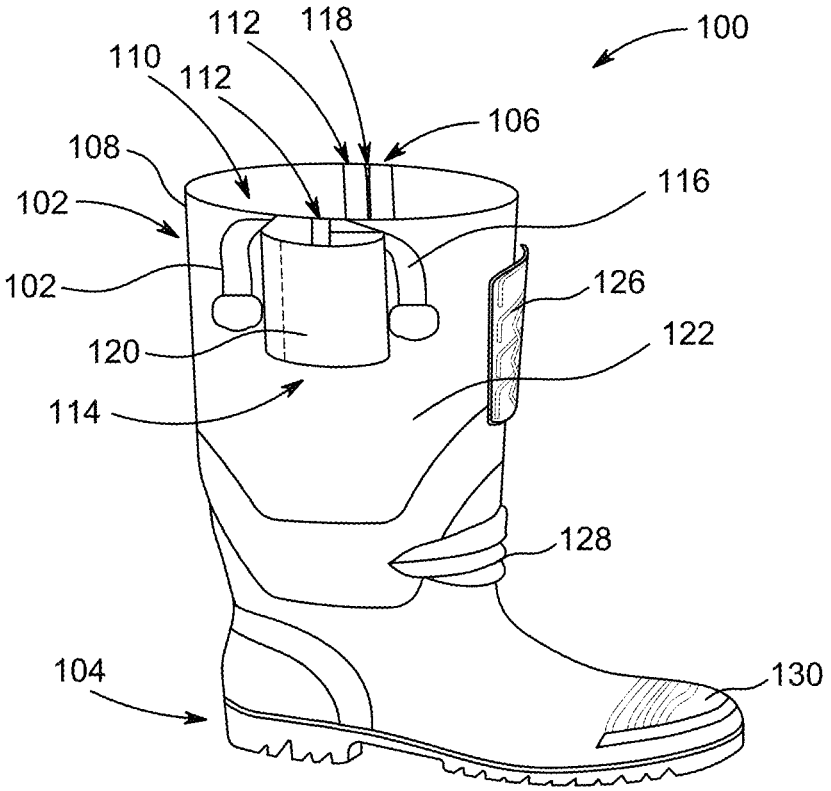
Figure 4A:
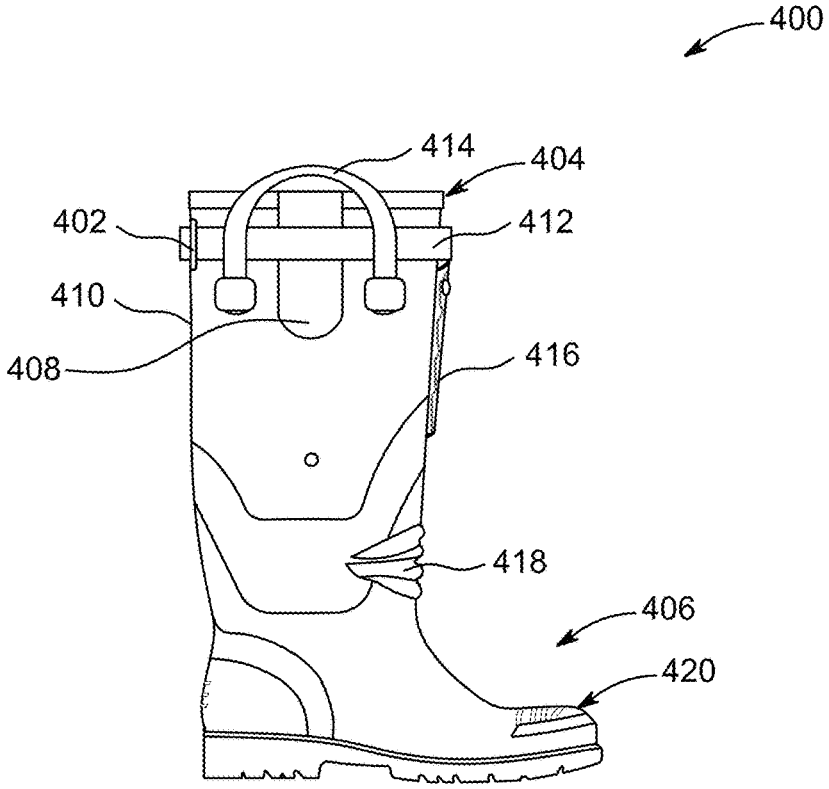
Figure 4B:
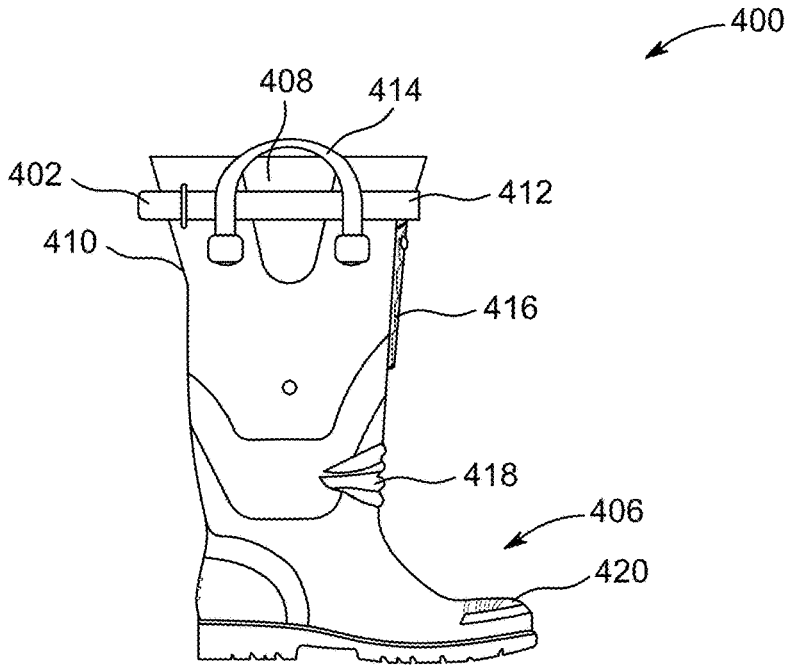
Figure 6A:
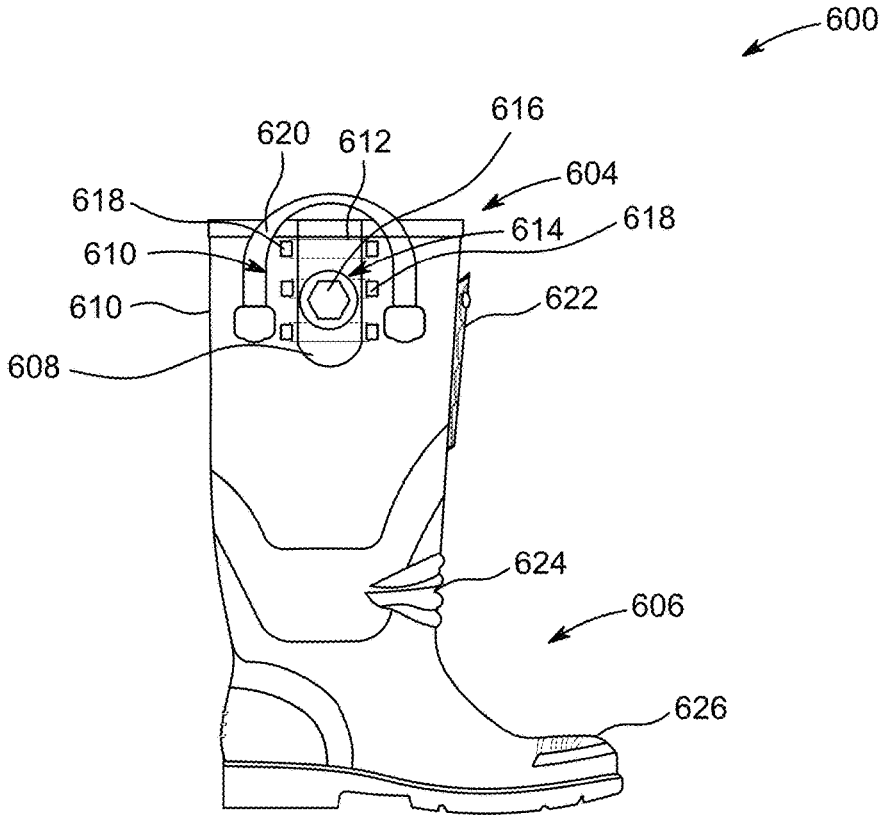
Figure 6B:
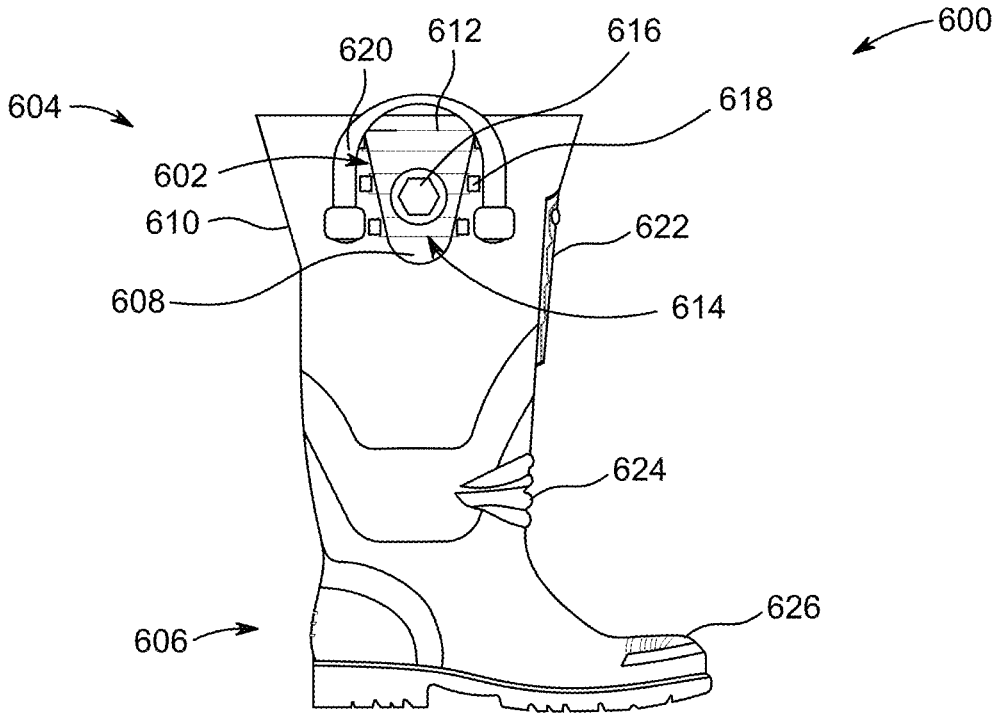

Having thus described certain example embodiments of this invention in general terms, reference will hereinafter be made to the accompanying drawings, which are not necessarily drawn to scale, and wherein:

FIG. 1 illustrates an isometric view of a calf adjustable boot having at least one zipper assembly in accordance with an example embodiment of this invention;

FIGS. 2A-2F illustrate upper shaft of the calf adjustable boot of FIG. 1 in accordance with an example embodiment of this invention;

FIGS. 3A-3D illustrate side views of the calf adjustable boot of FIG. 1 in accordance with an example embodiment of this invention;

FIGS. 4A-4B illustrate side views of another calf adjustable boot having at least one buckle in accordance with another example embodiment of this invention;

FIGS. 5A-5D illustrate side views of the calf adjustable boot of FIGS. 4A-4B in accordance with another example embodiment of this invention;

FIGS. 6A-6B illustrate side views of another calf adjustable boot having at least one lacing system in accordance with another example embodiment of this invention; and, FIGS. 7A-7D illustrate side views of the calf adjustable boot of FIGS. 6A-6B in accordance with another example embodiment of this invention.

DETAILED DESCRIPTION

Some embodiments will now be described more fully hereinafter with reference to the accompanying drawings, in which some, but not all, embodiments of this invention are shown. Indeed, various embodiments may be embodied in many different forms and should not be construed as limited to the embodiments set forth herein; rather, these embodiments are provided so that this disclosure will satisfy applicable legal requirements.

The components illustrated in the figures represent components that may or may not be present in various embodiments of this invention described herein such that embodiments may include fewer or more components than those shown in the figures while not departing from the scope of this invention. Some components may be omitted from one or more figures or shown in dashed line for visibility of the underlying components.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

The phrases "in various embodiments," "in one embodiment," "according to one embodiment," "in some embodiments," and the like generally mean that the particular feature, structure, or characteristic following the phrase may be included in at least one embodiment of this invention and may be included in more than one embodiment of this invention (importantly, such phrases do not necessarily refer to the same embodiment).

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such a component or feature may be optionally included in some embodiments or it may be excluded.

Various embodiments of this invention include calf adjustable boots. Embodiments may be configured to adjust the calf adjustable boots using one or more mechanisms. Embodiments may include at least one lining coupled to an inner surface of an upper shaft and at least one zipper assembly coupled to the upper shaft. The at least one zipper assembly is configured to adjust opening of the calf adjustable boot. In some embodiments, at least one strap wrapped around the upper shaft and at least one buckle coupled to the at least one strap, that are configured to adjust opening of the calf adjustable boot. In some embodiments, at least one lacing system disposed on an outer surface of the upper shaft, a knob and at least one ratcheting member is configured to lock at a plurality of positions for adjusting a circumference of the calf adjustable boot using the knob.

FIG. 1 illustrates an isometric view of a calf adjustable boot 100, in accordance with an example embodiment of this invention.

The calf adjustable boot 100 may comprise a first portion 102 and a second portion 104. In some embodiments, the first portion 102 and the second portion 104 may correspond to an upper shaft and a lower shaft of the calf adjustable boot 100, respectively. Hereinafter, the first portion 102 and the second portion 104 may be referred to as the upper shaft and the lower shaft, respectively. The calf adjustable boot 100 may include an at least one zipper assembly 106 and an at least one lining 108 coupled to an inner surface of the upper shaft 102. The at least one zipper assembly 106 may be coupled to the upper shaft 102 and configured to adjust opening of the calf adjustable boot 100. In some embodiments, the at least one zipper assembly 106 may be configured to lock at a plurality of positions 110 for adjusting circumference of the calf adjustable boot 100. In some embodiments, the plurality of positions may correspond to adjusting the circumference of the calf adjustable boot 100 from 20 inches to 24 inches.

The at least one zipper assembly 106 may define a top position 112 and a bottom position 114. The at least one zipper assembly 106 may comprise a tape 116 with a plurality of elements (not shown), and a slider 118 that may be configured to move from the top position 112 to the bottom position 114 along the plurality of elements of the tape 116. In some embodiments, moving the at least one slider 118 from the top position 112 to the bottom position 114 increases a circumference of the upper shaft 102.

Figures 3A, 3B, 3C, 3D:
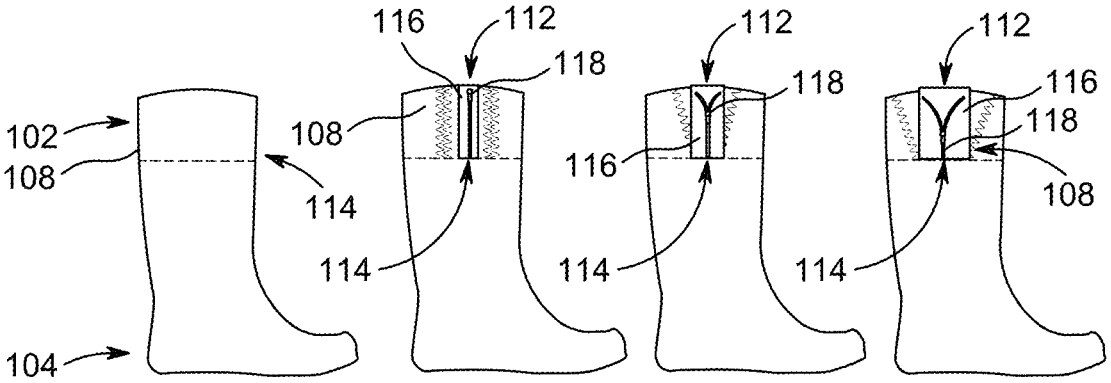

In some example embodiments, the upper shaft 102 may include at least one zipper assembly 106 on a right side, a left side, or both the right side and the left side. In some embodiments, each slider 118 may be configured to lock at the top position 112 and at the bottom position 114. In some example embodiments, each slider 118 may be a locking slider that is configured to lock at the plurality of positions. In some embodiments, the plurality of positions may include the top position 112, the bottom position 114, and at least one intermediate position 302 (FIG. 3C). At the top position 112, the zipper comes with a stopper. At the bottom position 114, a leather stitched to a zipper component which will hold the slider 118 at the bottom position 114. In some embodiments, each of the plurality of positions may be spaced apart from at least one adjacent position by a distance. The distance between each of the plurality of positions may be configured to adjust the circumference of the upper shaft 102 by an interval, each interval being equal. In some example embodiments, the interval may be equal to 1 inch. In some embodiments, each of the plurality of positions may be spaced apart from at least one adjacent position by a distance, and the distance for each is equal. In some embodiments, each zipper assembly 106 may comprise a top stop (not shown) that may be positioned proximate to a top of the calf adjustable boot 100. Further, each zipper assembly 106 may comprise a bottom stop (not shown) that may be positioned within 2 to 3 inches of a bottom of the calf adjustable boot 100.

Further, the at least one lining 108 may be coupled to an inner surface of the upper shaft 102. In some embodiments, the at least one lining 108 may correspond to a bellow lining of the calf adjustable boot 100. The bellow lining may be configured to expand as the circumference of the upper shaft 102 increases. In some example embodiments, the at least one lining 108 may be waterproof. In some embodiments, the at least one lining 108 may be bonded onto the inner surface of the upper shaft 102. In some embodiments, each lining 108 may be configured to prevent water from seeping into an interior of the calf adjustable boot 100.

Further, the calf adjustable boot 100 may comprise an at least one flap 120 coupled to an outer surface 122 of the upper shaft 102. In some embodiments, the at least one flap 120 may be stitched on an outer surface 122 of the upper shaft 102 of the calf adjustable boot 100. The at least one flap 120 may be configured to protect the at least one zipper assembly 106 and the at least one lining 108 from fire exposure. In some embodiments, each zipper assembly 106 may be positioned between a respective flap and a respective lining. In some embodiments, the at least one flap 120 may be a flame and heat-resistant material that is capable of withstanding temperature of 260 degrees Celsius. In some embodiments, each of the at least one flap 120 may comprise at least one of a plurality of hooks or a plurality of loops of a hook and loop fastener, such as a VELCRO® brand hook and loop fastener. The upper shaft 102 may comprise the other of the plurality of hooks or the plurality of loops of the hook and loop fastener.

In some embodiments, the calf adjustable boot 100 may comprise an at least two pull straps 124 stitched on an outer surface 122 of the upper shaft 102 and in proximity to the at least one zipper assembly 106. The at least two pull straps 124 may be configured to be pulled up to adjust the calf adjustable boot 100 near the calf. Further, the calf adjustable boot 100 may comprise a shin guard 126 disposed on the outer surface 122 of the upper shaft 102. In various embodiments, the shin guard 126 may be stitched towards the front side of the calf adjustable boot 100. In some example embodiments, the shin guard 126 may protect soft tissues and bones in lower extremities of the wearer of the calf adjustable boot 100 from external impact. The shin guard 126 may provide shock absorption and facilitate energy dissipation, thereby decreasing the risk of serious injuries to the wearer of the calf adjustable boot 100. In some embodiments, the length of the shin guard 126 may vary between 10 centimeters (cm) to 20 cm.

Further, the calf adjustable boot 100 may comprise a flex joint 128. The flex joint 128 may be disposed towards the lower shaft 104 of the calf adjustable boot 100. In some example embodiments, the flex joint 128 may enhance durability of the calf adjustable boot 100. Further, the calf adjustable boot 100 may have a toe tip 130. The toe tip 130 may be made from a material selected from a group of materials such as, but not limited to, carbon fiber or polycarbonate (PC). In some embodiments, the calf adjustable boot 100 may be made from a material selected from a group of materials such as, but is not limited to, leather, polyester mix, or rubber. In some embodiments, the calf adjustable boot 100 may have a height of 14 inches.

FIGS. 2A-2F illustrate portions of the upper shaft 102 of the calf adjustable boot 100 of FIG. 1, in accordance with an example embodiment of this invention. FIGS. 2A-2F are described in conjunction with FIG. 1.

Figure 2A:
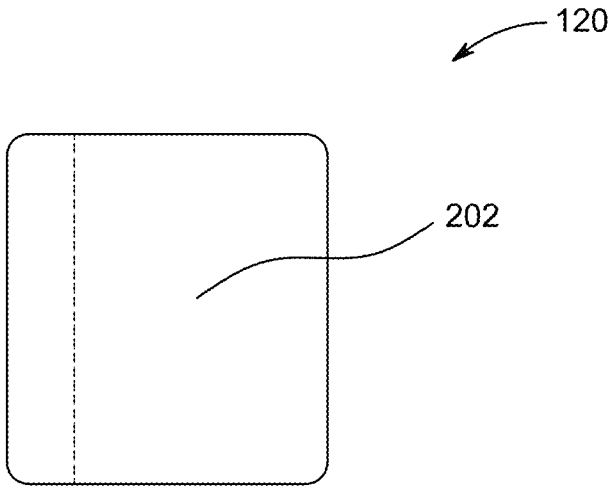
Figure 2B:
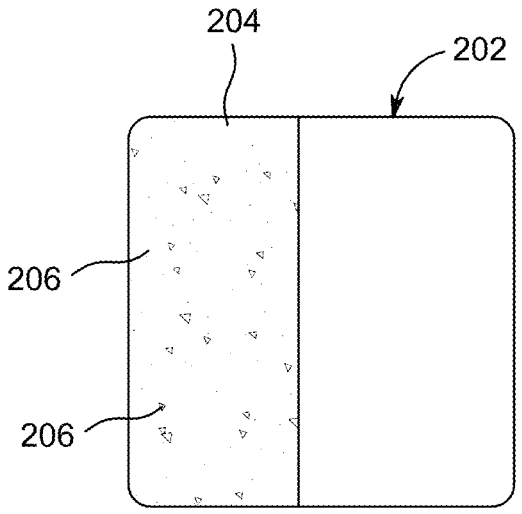
Figure 2C:
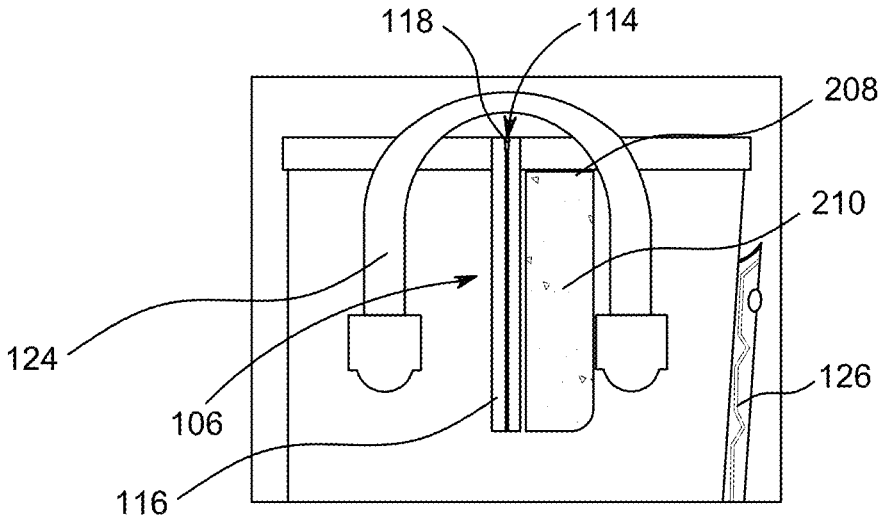
Figure 2D:
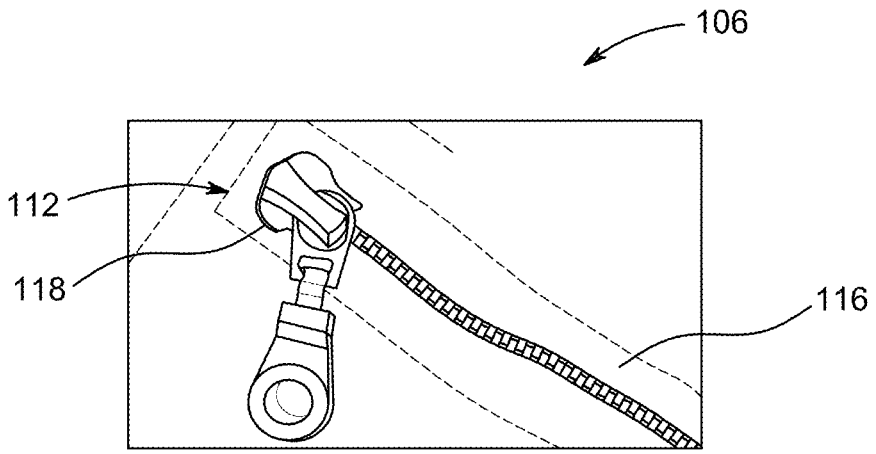
Figure 2E:
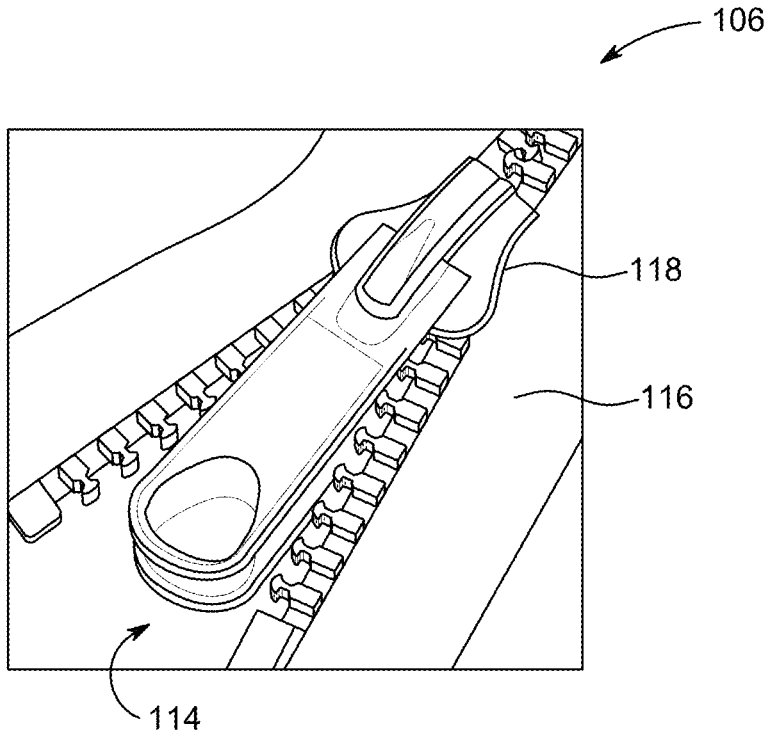
Figure 2F:
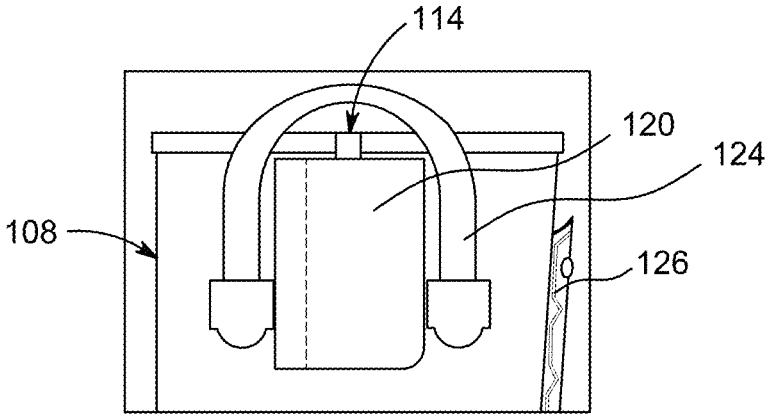

As illustrated in FIGS. 2A-2B, the at least one flap 120 may be a strip that is stitched on the outer surface 122 of the upper shaft 102 of the calf adjustable boot 100. In some embodiments, the at least one flap 120 may comprise an at least two sections 202 that are coupled to each other. Further, a section 204 of the at least two sections 202 may be fabricated with a plurality of loops 206, e.g., a plurality of loops of a hook and loop fastener, such as a VELCRO® brand hook and loop fastener. Further, a section 208 just beneath the section 204 of the at least two sections 202 of the at least one flap 120 may be fabricated with a plurality of hooks 210, e.g., a plurality of hooks of a hook and loop fastener, such as a VELCRO® brand hook and loop fastener. In some embodiments, the section 204 of the at least two sections 202 may be coupled via the plurality of loops 206 with the section 208 via the plurality of hooks 210.

In some embodiments, the at least two sections 202 of the at least one flap 120 may be stitched with each other. As illustrated in FIGS. 2C-2F, the length of the at least one zipper assembly 106 may not be equal to the length of the at least one flap 120. It may be noted that there may be clearance for stitching range of 0.2 to 0.5 inches. The at least one flap 120 may protect the at least one zipper assembly 106 and the at least one lining 108 from fire exposures. In some embodiments, the at least one zipper assembly 106 and the at least one flap 120 may facilitate flexible calf adjustments using the plurality hooks 210 and the plurality of loops 206. In various embodiments, the at least one zipper assembly 106 and the at least one flap 120 may be configured to adjust circumference of the calf adjustable boot 100. In various embodiments, locking of the plurality hooks 210 and the plurality of loops 206 may tighten the circumference of the calf adjustable boot 100. In various embodiments, unlocking of the plurality hooks 210 and the plurality of loops 206 may increase the circumference of the calf adjustable boot 100. In some example embodiments, the circumference of the calf adjustable boot 100 may be increased from 20 inches to 24 inches near the top of the upper shaft 102, e.g., near a top of the calf of a fire fighter. Such adjustment of the circumference may enable the fire fighter with greater mobility and reduced stress while performing firefighting duties. It may be noted that the adjustment of the circumference of the calf adjustable boot 100 near the top of the calf may minimize stress exerted by the fire fighter.

FIGS. 3A-3D illustrate side views of the calf adjustable boot 100 of FIG. 1, in accordance with an example embodiment of this invention. FIGS. 3A-3D are described in conjunction with FIGS. 1-2D.

As discussed earlier, the upper shaft 102 of the calf adjustable boot 100 may comprise the at least one zipper assembly 106 coupled to the upper shaft 102 and near the at least one lining 108. Further, the circumference of the calf adjustable boot 100 towards the upper shaft 102 may be adjusted by at least 1 inch on either side of the at least zipper 106. As illustrated in FIG. 3B, the at least one zipper assembly 106 may be in a fully closed position. In this case, the at least one lining 108 may have a straight line-up with the at least one zipper assembly 106. The slider 118 may be locked at the top position 112. The calf adjustable boot 100 may have the circumference of 20 inches. It may be noted that in the fully closed position, the circumference of the calf adjustable boot 100 may be limited to 20 inches.

As illustrated in FIG. 3C, the at least one zipper assembly 106 may be in a half open position. In this case, the at least one lining 108 may be 1 inch apart on either side of the at least one zipper assembly 106. The slider 118 may be locked at the intermediate position 302. In various embodiments, the half open position may be held by the slider 118 into the plurality of elements of the at least one zipper assembly 106 and supported by the at least one lining 108. In the half open position, the circumference of the calf adjustable boot 100 may increase to 21 inches, 22 inches, or 23 inches.

As illustrated in FIG. 3D, the at least one zipper assembly 106 may be in fully open position. In this case, the at least one lining 108 may be 2 inches apart from either side of the at least one zipper assembly 106. The slider 118 may be locked at the bottom position 114. In some embodiments, the fully open position may correspond to a position when the firefighter either removes or wears the calf adjustable boot 100. In the fully open position, the circumference of the calf adjustable boot 100 may increase to 24 inches. In some example embodiments, the fully closed position, the half open position or the half-closed position, the fully open position and inter alia, may correspond to the plurality of positions. It may be noted that the firefighter may adjust the circumference of the calf adjustable boot 100 based on his/her calf muscle thickness and comfort level. In some example embodiments, the hook and loop fastener of the at least one flap 120 may support calf adjustment when the at least one zipper assembly 106 is half-open, protecting the calf adjustable boot 100 from direct heat and fire exposure.

FIGS. 4A-4B illustrate side views of a calf adjustable boot 400 having an at least one buckle 402, in accordance with another example embodiment of this invention.

The calf adjustable boot 400 may comprise an upper shaft 404 and a lower shaft 406. It may be noted that the upper shaft 404 and the lower shaft 406 of the calf adjustable boot 400 may be similar to the upper shaft 102 and the lower shaft 104 of the calf adjustable boot 100, as illustrated in FIGS. 1-3D.

The calf adjustable boot 400 may comprise an at least one elastic member 408 supported by an at least one lining 410 coupled to an inner surface of the upper shaft 404. The at least one elastic member 408 may be configured to adjust opening of the calf adjustable boot 400. In some embodiments, the at least one elastic member 408 may be stitched by way of incorporation in the at least one lining 410 on either sides of the calf adjustable boot 400 towards the upper shaft 404. In some example embodiments, the at least one elastic member 408 may be made from a material selected from a group of materials such as, but is not limited to, rubber, polyester, combination of rubber and polyester, and other elastic materials having elasticity nearly 10. In some example embodiments, the at least one elastic member 408 may facilitate the plurality of positions with a standard or retracted calf opening at 20 inches, as illustrated in FIG. 4A and an extended calf opening at 24 inches, as illustrated in FIG. 4B.

In some embodiments, the calf adjustable boot 400 may comprise an at least one strap 412. The at least one strap 412 may be wrapped around the upper shaft 404. Further, the at least one strap 412 may be coupled with the at least one buckle 402. The at least one strap 412 and the at least one buckle 402 may be configured to lock at a plurality of positions for adjusting a circumference of the calf adjustable boot 400. In some embodiments, the at least one strap 412 may correspond to a leather strap, or a hook and loop fastener. In some embodiments, the at least one strap 412 may be made from a material selected from a group of materials such as, but is not limited to, cotton, polyester, or leather. In some embodiments, the at least one strap 412 may be coated with a fire-resistant material.

In some embodiments, the at least one buckle 402 may be a fire-retardant plastic buckle protector. The at least one buckle 402 may be made from a flame and heat-resistant material capable of withstanding temperatures of approximately 260 degrees Celsius. The at least one buckle 402 may be configured to protect the at least one strap 412 and the at least one lining i.e., bellow lining 410 from fire exposure. In some embodiments, the calf opening of the calf adjustable boot 400 may be adjusted by expanding or retracting the at least one elastic member 408 and secured by the at least one strap 412 and the at least one buckle 402. In some alternate embodiments, the hook and loop fastener may be configured to secure the calf opening after adjustment of the at least one strap 412.

Further, the upper shaft 404 of the calf adjustable boot 400 may comprise an at least two pull straps 414. The at least two pull straps 414 may be stitched in proximity to the at least one elastic member 408. The at least two pull straps 414 may be configured to be pulled up to adjust the calf adjustable boot 400 near the calf. Further, the calf adjustable boot 400 may comprise a shin guard 416 disposed towards the upper shaft 404 of the calf adjustable boot 400. In various embodiments, the shin guard 416 may be stitched towards front side of the calf adjustable boot 400. In some example embodiments, the shin guard 416 may protect soft tissues and bones in lower extremities from external impact. The shin guard 416 may provide shock absorption and facilitate energy dissipation, thereby decreasing the risk of serious injuries. In some embodiments, the length of the shin guard 416 may vary between 10 centimeters (cm) to 20 cm.

Further, the calf adjustable boot 400 may comprise a flex joint 418. The flex joint 418 may be disposed towards the lower shaft 406 of the calf adjustable boot 400. In some example embodiments, the flex joint 418 may enhance durability of the calf adjustable boot 400. Further, the calf adjustable boot 400 may have a toe tip 420. The toe tip 420 may be made from a material selected from a group of materials such as, but is not limited to, carbon fiber, and polycarbonate (PC). In some embodiments, the calf adjustable boot 400 may be made from a material selected from a group of materials such as, but is not limited to, leather, polyester mix, or rubber.

FIGS. 5A-5D illustrate side views of the calf adjustable boot 400 of FIGS. 4A-4B, in accordance with an example embodiment of this invention. FIGS. 5A-5D are described in conjunction with FIGS. 4A-4B.

Figures 5A, 5B, 5C, 5D:
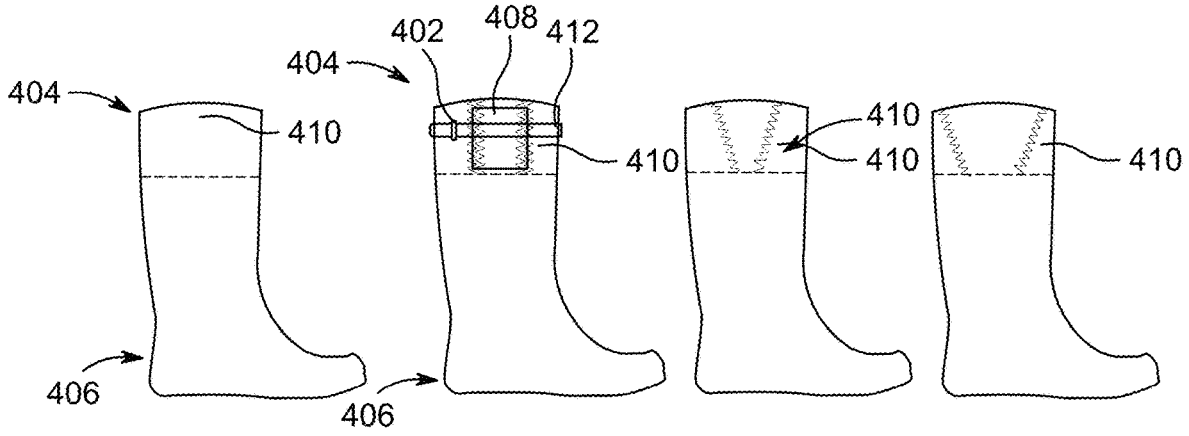

As discussed earlier, the calf opening of the calf adjustable boot 400 may be adjusted at the plurality of positions. The at least one elastic member 408 incorporated into the at least one lining 410 along with the at least one strap 412, may facilitate a fully closed position, a half open or half-closed position, and a fully open position of the calf adjustable boot 400. Further, the at least one elastic member 408 may facilitate the plurality of positions with the standard or retracted calf opening at 20 inches and the extended calf opening at 24 inches. As illustrated in FIG. 5A, the extension of 4 inches of the circumference of the calf opening of the calf adjustable boot 400, may be 2 inches on either side of the upper shaft 404. It may be noted that the extension is elastic, such that any position between the maximum extension and the maximum retraction of the at least one elastic member 408, may fit the firefighter.

As illustrated in FIG. 5B, the calf adjustable boot 400 may be at the fully closed position with calf opening at 20 inches, and the at least one strap 412 may be tightened using the at least one buckle 402. In this case, the at least one elastic member 408 may be in the retracted state. As illustrated in FIG. 5C, the calf adjustable boot 400 may be at the half-open or half-closed position. The calf opening may be at 22 inches in circumference. In some embodiments, the at least one lining 410, at one point towards the calf opening, may be separated by 1 inch on each side. As illustrated in FIG. 5D, the calf adjustable boot 400 may be at the fully open position. The calf opening may be at 24 inches in circumference. In this case, the at least one lining 410 may be, at the one point towards the calf opening, separated by 2 inches on each side. In some example embodiments, the fully closed position, the half open position or the half-closed position, the fully open position and inter alia, may correspond to the plurality of positions. It may be noted that the circumference of the calf adjustable boot 400 may be automatically adjusted based on his/her calf muscle thickness and comfort level.

FIGS. 6A-6B illustrate side views of calf adjustable boot 600 having at least one lacing system 602, in accordance with another example embodiment of this invention.

The calf adjustable boot 600 may comprise a upper shaft 604 and a lower shaft 606. It may be noted that the upper shaft 604 and the lower shaft 606 of calf adjustable boot 600 may be similar to the upper shaft 102 and the lower shaft 104 of the calf adjustable boot 100, as illustrated in FIGS. 1-3D, and similar to the upper shaft 404 and the lower shaft 406 of the calf adjustable boot 400, as illustrated in FIGS. 4A-5D.

The calf adjustable boot 600 may comprise an at least one elastic member 608 that may be supported by at least one lining 610. The at least one elastic member 608 may be configured to adjust opening of the calf adjustable boot 600. It may also be noted that the at least one elastic member 608 may perform similar operations as the at least one elastic member 408 of the calf adjustable boot 400, as illustrated in FIGS. 4A-5D.

Further, the calf adjustable boot 600 may comprise the at least one lacing system 602 disposed on an outer surface of the upper shaft 604. Each lacing system 602 may comprise at least one cable 612 coupled to the outer surface of the upper shaft 604. In some embodiments, each lacing system 602 may include an at least one ratcheting member 614. Each ratcheting member 614 may be coupled to a respective cable and may comprise a knob 616. In some embodiments, each ratcheting member 614 may be configured to lock at a plurality of positions for adjusting a circumference of the calf adjustable boot 600 by rotating the knob 616. In some embodiments, the knob 616 may be rotated either clockwise or counterclockwise to contract or expand the at least one cable 612 and thereby adjust the calf opening of the calf adjustable boot 600. Therefore, the at least one cable 612 may be adjusted by rotating the knob 616 of the at least one ratcheting member 614 to achieve the desired calf opening.

As illustrated in FIGS. 6A-6B, each lacing system 602 may comprise at least one cable 612 coupled to the outer surface of the upper shaft 604 at a plurality of attachment points 618 (e.g., a plurality of hooks or a plurality of loops). Each attachment point 618 may be arranged on either side of the at least one elastic member 608. Each attachment point 618 may be configured to receive securely the at least one cable 612. In some example embodiments, each attachment point 618 may be stitched to the at least one lining 610, such that the at least one cable 612 secured over the plurality of attachment points 618, does not detach from the calf adjustable boot 600. In some embodiments, the at least one elastic member 608, the at least one cable 612 and the at least one ratcheting member 614 may be fire-retardant materials configured to protect the at least one lacing system 602 and the at least one lining 610 from fire exposure. In some example embodiments, the at least one cable 612 may be made from a material selected from a group of materials of fire-resistant materials such as, metals, alloys, or carbon fiber, to ensure desired calf adjustment during harsh conditions.

Further, the calf adjustable boot 600 may comprise at least two pull straps 620. The at least two pull straps 620 may be stitched on an outer surface of the upper shaft 604 and in proximity to the at least one elastic member 608. The at least two pull straps 620 may be configured to be pulled up to adjust the calf adjustable boot 600 near the calf. Further, the calf adjustable boot 600 may comprise a shin guard 622 disposed towards the upper shaft 604 of the calf adjustable boot 600. In various embodiments, a shin guard 622 may be stitched towards front side of the calf adjustable boot 600. In some example embodiments, the shin guard 622 may protect soft tissues and bones in lower extremities from external impact. The shin guard 622 may provide shock absorption and facilitate energy dissipation, thereby decreasing the risk of serious injuries. In some embodiments, the length of the shin guard 622 may vary between 10 centimeters (cm) to 20 cm.

Further, the calf adjustable boot 600 may comprise a flex joint 624. The flex joint 624 may be disposed towards the lower shaft 606 of the calf adjustable boot 600. In some example embodiments, the flex joint 624 may enhance durability of the calf adjustable boot 600. Further, the calf adjustable boot 600 may have a toe tip 626. The toe tip 626 may be made from a material selected from a group of materials such as, but is not limited to, carbon fiber or polycarbonate (PC). In some embodiments, the calf adjustable boot 600 may be made from a material selected from a group of materials such as, but is not limited to, leather, polyester mix, or rubber.

FIGS. 7A-7D illustrate side views of the calf adjustable boot 600 of FIGS. 6A-6B, in accordance with another example embodiment of this invention. FIGS. 7A-7D are described in conjunction with FIGS. 6A-6B.

As discussed earlier, the calf opening of the calf adjustable boot 600 may be adjusted at the plurality of positions. The at least one elastic member 608 incorporated into the at least one lining 610 along with the at least one lacing system 602, may facilitate a fully closed position, a half open or half-closed position, and a fully open position of the calf adjustable boot 600. Further, the rotation of the knob 616 of the at least one ratcheting member 614 may adjust the at least one cable 612 and therefore, may facilitate the plurality of positions with the standard or retracted calf opening at 20 inches and the extended calf opening at 24 inches.

Figures 7A, 7B, 7C, 7D:
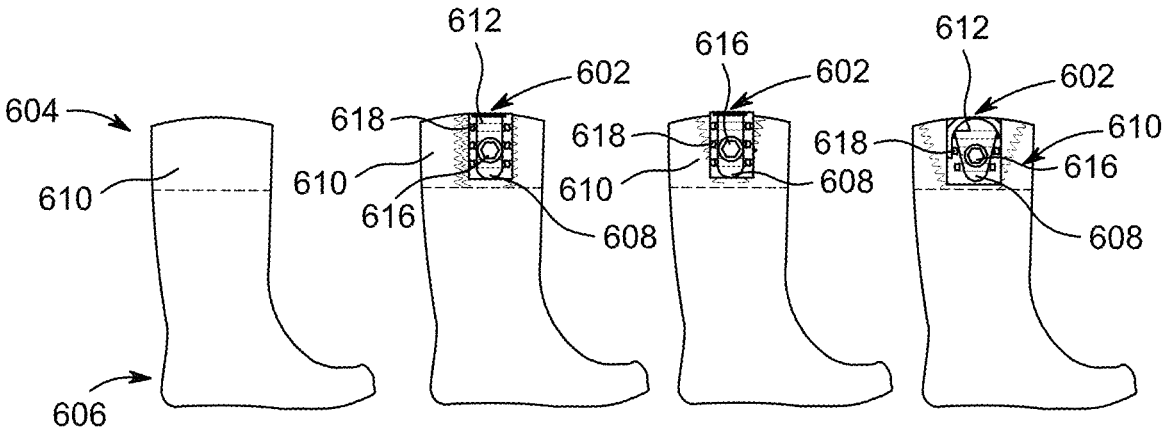

As illustrated in FIG. 7A, the extension of 4 inches of the circumference of the calf opening of the calf adjustable boot 600, may be 2 inches on either side of the upper shaft 604. It may be noted that the extension is elastic, such that any position between the maximum extension and the maximum retraction of the at least one elastic member 608, may fit the firefighter. As illustrated in FIG. 7B, the calf adjustable boot 600 may be in fully closed position. The calf opening may be at 20 inches of circumference. In this case, the knob 616 may be rotated to stretch the at least one cable 612 underneath the at least one ratcheting member 614. In the fully closed position, the circumference of 20 inches may be suitable with at least one lining 610 parallel opposing each other.

As illustrated in FIG. 7C, the calf adjustable boot 600 may be in a partial open position. The calf opening may be at 22 inches of circumference. In this case, the knob 616 may be rotated, such that the at least one cable 612 may be extended and the at least one lining 610 may be separated by 1 inch on each side of the at least one elastic member 608. As illustrated in FIG. 7D, the calf adjustable boot 600 may be in fully open position. The calf opening may be at 24 inches of circumference. In this case, the knob 616 may be rotated such that the at least one cable 612 may be extended and the at least one lining 610 may be separated by 2 inches on each side of the at least one elastic member 608. It may be noted that the firefighter may adjust the circumference of the calf adjustable boot 600 based on his/her calf muscle thickness and comfort level. In some example embodiments, the at least one elastic member 608 may support calf adjustment when the at least one lacing system 602 is half-open, protecting the calf adjustable boot 600 from direct heat and fire exposure.

In some embodiments, the firefighter may insert his/her feet into the calf adjustable boot 600, the at least one elastic member 608 may get stretched by adjusting the calf muscles. Further, the at least one lacing system 602 may secure the at least one lining 610 by rotating the knob 616 of the at least one ratcheting member 614 to secure the at least one cable 612. It may be noted that the plurality of positions, e.g., the fully closed position the half-open position, the fully open position, may vary according to the adjustment of the at least one zipper assembly 106, the at least one strap 412 and the at least one lacing system 602. Any position between the fully open and fully closed positions, may be secured by way of the one or more fasteners, i.e., the at least one zipper assembly 106, the at least one strap 412 and the at least one lacing system 602. It will be apparent to one skilled in the art that above-mentioned materials of the calf adjustable boots 100, 400, and 600 have been provided only for illustration purposes, without departing from the scope of the disclosure.

In various embodiments, the calf adjustable boots 100, 400, and 600 may be designed as per the standard procedures. In some example embodiments, the calf adjustable boots of this invention have a distinctive visibility with at least one lining construction for the calf adjustments at the plurality of positions. The calf adjustable boot or calf adjustable fire boots may be adjusted in at least three variants having different calf opening circumferences, e.g., 20-24 inches. The calf adjustable fire boots of this invention may eliminate the problem of firefighters with shorter and heavy build calf muscles. Such adjustment of the calf opening of the calf adjustable fire boots may improve lower extremity mobility while walking, duck walking and stair maneuvering. At least one lining may reduce physical stress and minimal risk of injury and thereby improve overall work performance of the firefighter.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A calf adjustable boot comprising:

an upper shaft;

at least one lining coupled to an inner surface of the upper shaft;

at least one zipper assembly coupled to the upper shaft, wherein each zipper assembly comprises at least one slider; and at least one pull strap, wherein the at least one pull strap extends across the at least one zipper assembly, wherein each slider is configured to move from a top position to a bottom position, wherein moving the at least one slider from the top position to the bottom position increases a circumference of the upper shaft.

2. The calf adjustable boot of claim 1, wherein each slider is configured to lock at the top position and at the bottom position.

3. The calf adjustable boot of claim 1, wherein each slider is configured to lock at a plurality of positions.

4. The calf adjustable boot of claim 3, wherein the plurality of positions comprising the top position, the bottom position, and at least one intermediate position.

5. The calf adjustable boot of claim 4, wherein each of the plurality of positions are spaced apart from at least one adjacent position by a distance, wherein the distance between each of the plurality of positions is configured to adjust the circumference of the upper shaft by an interval, each interval being equal.

6. The calf adjustable boot of claim 5, wherein each interval is 1 inch.

7. The calf adjustable boot of claim 1, wherein the at least one zipper assembly includes a first zipper assembly coupled to a first side of the upper shaft and a second zipper assembly coupled to a second side of the upper shaft opposite to the first zipper assembly.

8. The calf adjustable boot of claim 1, wherein each lining is waterproof.

9. The calf adjustable boot of claim 1, wherein each lining is bonded onto the inner surface of the upper shaft.

10. The calf adjustable boot of claim 1, where each lining is waterproof and is configured to prevent water from seeping into an interior of the calf adjustable boot.

11. The calf adjustable boot of claim 1, where each lining is configured to expand as the circumference of the upper shaft increases.

12. The calf adjustable boot of claim 1, further comprising at least one flap coupled to an outer surface of the upper shaft, wherein the at least one zipper assembly is positioned between the at least one flap and the at least one lining, wherein the at least one flap is configured to protect the at least one zipper assembly and the at least one lining from fire exposure.

13. The calf adjustable boot of claim 12, wherein the at least one flap is coupled to the outer surface of the upper shaft to cover the bottom position of the at least one zipper assembly.

14. The calf adjustable boot of claim 13, wherein the at least one flap is coupled to the outer surface of the upper shaft to cover a majority of a length of the at least one zipper assembly between the top position and the bottom position.

15. The calf adjustable boot of claim 12, wherein the at least one flap is a flame and heat-resistant material that is capable of withstanding temperature of 260 degrees Celsius.

16. The calf adjustable boot of claim 12, wherein each of the at least one flap comprises at least one of a plurality of hooks or a plurality of loops of a hook and loop fastener.

17. The calf adjustable boot of claim 1, wherein the at least one pull strap is stitched on an outer surface of the upper shaft and in proximity to the at least one zipper assembly, wherein the at least one pull strap is configured to be pulled up to adjust the calf adjustable boot near the calf.

18. A calf adjustable boot comprising:

an upper shaft;

at least one lining coupled to an inner surface of the upper shaft;

at least one zipper assembly coupled to the upper shaft, wherein each zipper assembly comprises at least one slider; and at least one flap coupled to an outer surface of the upper shaft, wherein each slider is configured to move from a top position to a bottom position, wherein moving the at least one slider from the top position to the bottom position increases a circumference of the upper shaft, wherein the at least one flap is coupled to the outer surface of the upper shaft to cover the bottom position of the at least one zipper assembly.

19. The calf adjustable boot of claim 18, wherein the at least one flap is coupled to the outer surface of the upper shaft to cover a majority of a length of the at least one zipper assembly between the top position and the bottom position.

20. The calf adjustable boot of claim 18, wherein the at least one zipper assembly is positioned between the at least one flap and the at least one lining, wherein the at least one flap is configured to protect the at least one zipper assembly and the at least one lining from fire exposure.

* * * * *